United States Patent [19]

Nakase

[11] Patent Number: 4,929,961

[45] Date of Patent: May 29, 1990

[54] NON-GROUNDED TYPE ULTRAHIGH FREQUENCY ANTENNA

[75] Inventor: Kazuhiko Nakase, Tokyo, Japan

[73] Assignee: Harada Kogyo Kabushiki Kaisha, Tokyo, Japan

[21] Appl. No.: 342,181

[22] Filed: Apr. 24, 1989

[51] Int. Cl.[5] ..... H01Q 1/32; H01Q 9/38

[52] U.S. Cl. ..... 343/715; 343/846; 343/829

[58] Field of Search ..... 343/713, 715, 846, 900, 343/848, 847, 711, 712, 829, 830

[56] References Cited

U.S. PATENT DOCUMENTS

| | | | |
|---|---|---|---|
| 4,342,037 | 7/1982 | Dalby | 343/846 |
| 4,644,361 | 2/1987 | Yokoyama | 343/700 MS |
| 4,658,266 | 4/1987 | Doty, Jr. | 343/846 |

*Primary Examiner*—Rolf Hille
*Assistant Examiner*—Doris J. Johnson
*Attorney, Agent, or Firm*—Koda & Androlia

[57] ABSTRACT

A non-grounded type ultrahigh frequency antenna including an antenna element having a length of λ/2 at a working frequency, a casing provided at the base of the antenna element, a metal section of the casing having a length of approximately λ/4 at the working frequency, and a metal plate provided in the casing and parallel to the metal section, one end of the metal plate being connected to the metal section and other end to the antenna element. The antanna is made parallel-resonant within a working frequency band by an electrostatic capacitance created between the metal plate and metal section and an inductance of the metal plate. The antenna element can be made slightly shorter than a length λ/2 at the working frequency and another metal plate can be provided between the antenna element and the metal plate so that a constant K-filter is formed by an electrostatic capacitance created by the another metal plate and the metal plate and a residual inductance of the antenna element.

4 Claims, 3 Drawing Sheets

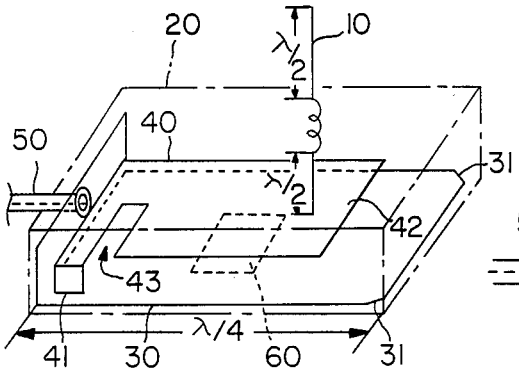
FIG. 1
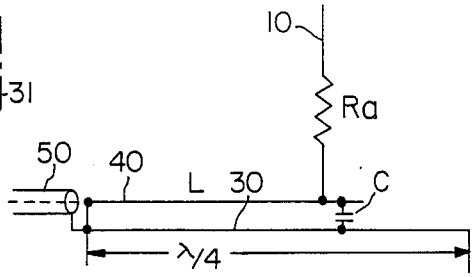
FIG. 2
FIG. 3
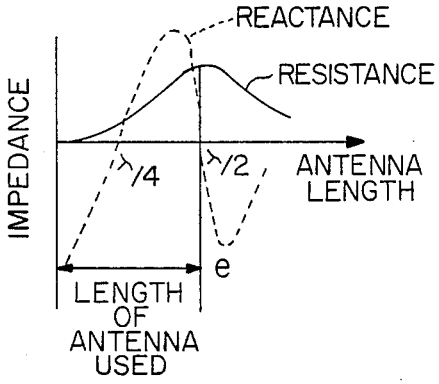
FIG. 4
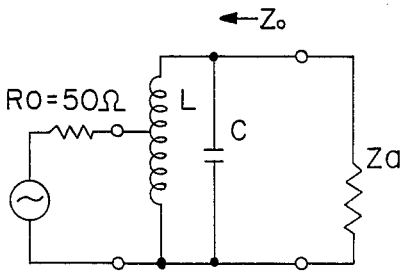

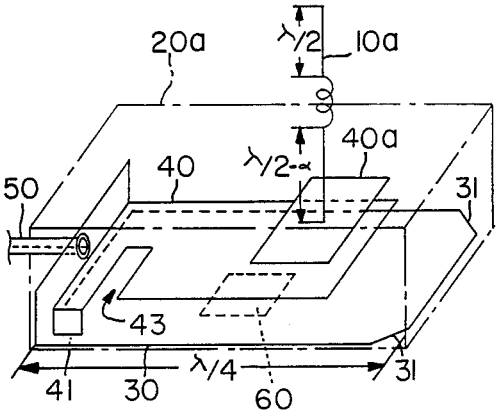
FIG. 5
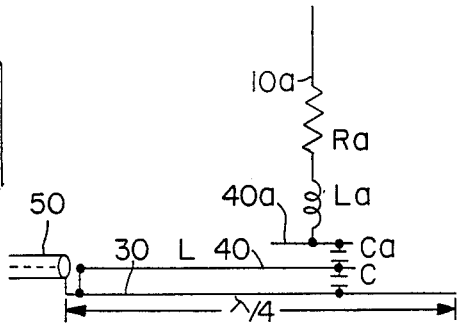
FIG. 6
FIG. 7
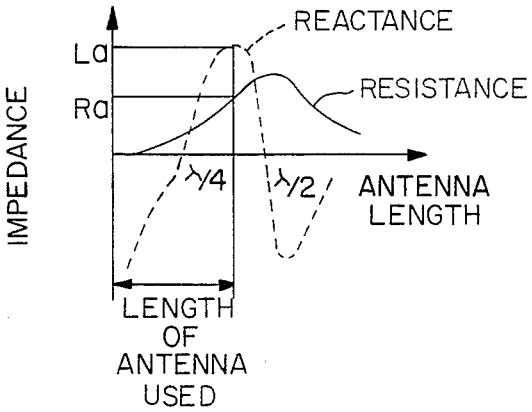
FIG. 8
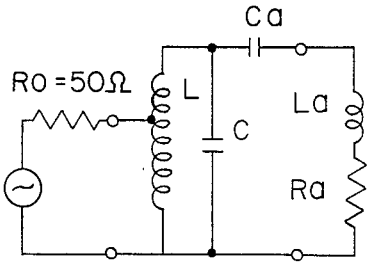

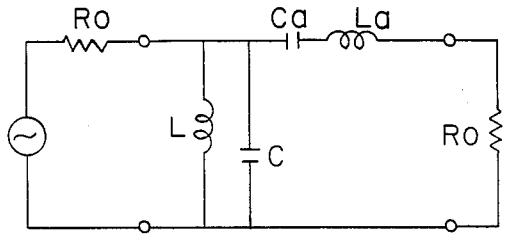
FIG. 9a
$$L = \frac{W2 - WI}{Wo^2} \cdot Ro$$
$$La = \frac{Ro}{W2 - WI}$$
$$C = \frac{1}{(W2 - WI)\,R}$$
$$Ca = \frac{W2 - WI}{Wo^2 \cdot R}$$
FIG. 9b
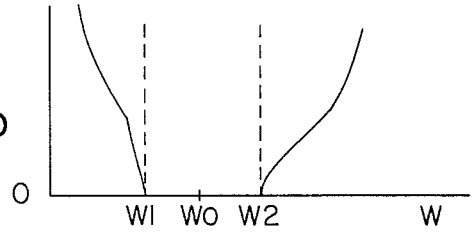
FIG. 10 PRIOR ART
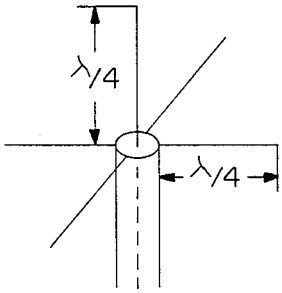
FIG. 11 PRIOR ART
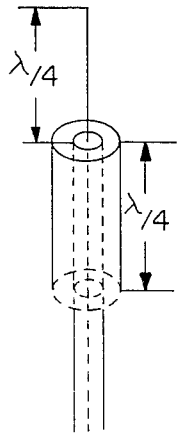

NON-GROUNDED TYPE ULTRAHIGH FREQUENCY ANTENNA

BACKGROUND OF THE INVENTION

1. Field of the Invention

The present invention relates to a non-grounded type ultrahigh frequency antenna used for cellular phones, etc.

2. Prior Art

Some conventional antennas are used as non-grounded type antennas by setting the antenna length to be λ/2 so that the antenna is caused to be parallel resonant within the working frequency band and raising the impedance of a feeder so as to reduce unbalanced earth currents. In these conventional antennas, it is impossible to raise the antenna impedance at resonance above a predetermined level, which is approximately 200 to 500 ohm. Accordingly, complete non-grounding is not obtainable, and the antennas is not broad-band. For this reason, the conventional antennas, with special exceptions, can only be used for portable wireless telegraphs in which the inside radio set and antenna are directly connected.

Brown antennas as illustrated in FIG. 10 are one of the non-grounded type antennas known in the prior art. This antenna has several (for example four) ground wires each having a length λ/4 and being attached to a connecting point between the antenna and a coaxial feeder. The impedance of the grounding side is set higher to eliminate unbalanced earth currents. In this way, the Brown antenna is usable as a non-grounded type antenna.

Another example of prior art non-grounded type antenna is a wave-trap type antenna as shown in FIG. 11. In this antenna, a coaxial trapping circuit, which is of λ/4 length and connected to a coaxial outer wire, is provided between the antenna and a coaxial feeder so that the antenna is usable as a non-grounded type antenna.

In the Brown antenna, since a large space is required for its base section, the appearance of the entire antenna tends to be unpleasant and poor. On the other hand, since the wave-trap type antenna has a narrow band, two or three steps of antenna rods are usually required so that the antenna is usable as a broad band antenna. Furthermore, because a relatively large diameter cylinder of λ/4 length is mounted at the base of the wave-trap antenna, the overall antenna length becomes fairly long. In addition, because of such a large-diameter cylinder, the antenna does not have the appearance of being light weight.

SUMMARY OF THE INVENTION

Accordingly, it is a primary object of the present invention to provide a non-grounded type antenna which requires only a limited, small space for the base thereof.

It is another object of the present invention to provide an antenna which can attain an appearance of being light in weight.

The abovementioned and other objects of the present invention are accomplished by a unique structure for a non-grounded type ultrahigh frequency antenna which includes: an antenna element having a length λ/2 at the working frequency or its multiplied length (N×λ/2, where N is an integer); a casing on which the antenna element is provided at the base thereof; a metal section, which is a part of the casing and has a length λ/4 at the working frequency; and a long and narrow metal plate provided in the casing, one end of the metal plate being grounded and the other end being connected to the antenna element. By utilizing an electrostatic capacitance created between the metal section and the metal plate and an inductance of the metal plate, the antenna is made parallel-resonant within the working frequency band.

Furthermore, according to the present invention, an antenna element having a length slightly shorter than the length λ/2 or its multiplied length is used along with another metal plate provided between the antenna element and the metal plate so that a constant K-filter is formed by an electrostatic capacitance created between the two metal plates and a residual inductance of the antenna element.

Thus, according to the present invention, the metal section which is a part of the casing and has a length λ/4 is used as a ground wire. Therefore, the space for the base of the antenna does not need to be very large, and an appearance of being light weigh can be secured. Furthermore, by a parallel resonance circuit formed by an electrostatic capacitance created between the long, thin metal plate (one end of which is grounded and other end connected to the antenna element) and the metal section of the casing, and an inductance of the metal plate, it is possible for the antenna element and feeder be matched.

BRIEF DESCRIPTION OF THE DRAWINGS

FIG. 1 is a perspective view of the first embodiment of the antenna according to the present invention;

FIG. 2 is an illustration of an equivalent circuit for the antenna of the first embodiment;

FIG. 3 is a characteristic curve of the antenna of first embodiment;

FIG. 4 is a diagram of the equivalent circuit of the first embodiment;

FIG. 5 is a perspective view of the second embodiment of the antenna of the present invention;

FIG. 6 is an illustration of an equivalent circuit for the antenna of the second embodiment;

FIG. 7 is a characteristic curve of the antenna of the second embodiment;

FIG. 8 is a diagram of the equivalent circuit for the antenna of the second embodiment;

FIGS. 9(1) and 9(2) are explanatory illustrations of a constant K-filter in the second embodiment;

FIG. 10 is a perspective view of prior art Brown antenna; and

FIG. 11 is a perspective view of prior art wave-trap antenna.

DETAILED DESCRIPTION OF THE INVENTION

FIG. 1 shows a first embodiment of this invention. In this Figure, the vertical dimension compared to the horizontal dimension is shown shorter than it actually is.

The antenna rod or antenna element 10 is a collinear type having a length twice the length λ/2 at a working frequency.

A casing 20 for the antenna element 10 is relatively flat, and the base portion of the antenna element 10 is mounted in this casing 20. The casing 20 has a metal section 30 and a metal plate 40.

The metal section 30 is a part of the casing 20 and has a length of approximately $\lambda/4$ at the working frequency. Two ends 31 of the metal section 30 are irregularly cut out, that is, they are cut out triangular.

The metal plate 40 is provided above and parallel to the metal section 30 of the casing 20. One end 41 of the metal plate 40 is grounded, in other words, one end 41 is connected to the metal section 30, and the antenna element 10 is connected at its base near the other end 42 of the metal plate 40. The metal plate 40 is of long and narrow shape and provided with a cut-out portion 43.

The center conductor of a coaxial cable 50 is connected to the metal plate 40, and the outer covering of the cable 50 is connected to the upright portion of the metal section 30.

With the above structure, the antenna element 10 is made parallel-resonant within the working frequency band by the electrostatic capacitance created between the metal plate 40 and the metal section 30 and an inductance L of the metal plate 40.

FIG. 2 is an illustration of an equivalent circuit of the above embodiment.

An explanation will be given on the function of the above described antenna.

When the antenna element 10 having the length $\lambda/2$ or its multiplied length is resonant, the reactance is zero (0) and the resistance is generally stable at high a level as seen in FIG. 3.

In the equivalent circuit which includes the antenna element 10, by changing the position of the tap of the inductor (i.e. by changing the position measured from the end 41 of the metal plate 40), impedance $Z_o$, which is observed from the connection side of the antenna element 10 and metal plate 40 to the signal source side, becomes equal to the antenna impedance $Z_a$. Thus, a complete matching of the coaxial cable 50 and the antenna element 10 is obtained.

Since the length of the metal section 30 is set $\lambda/4$ at the working frequency, it results in as if a wide, plate-like ground wire (metal section 30) having a length $\lambda/4$ was connected to the ground side conductor, thus reducing unbalanced earth currents. Also, since the ground wire metal plate 30 is of wide plate-like shape and its ends 31 are irregularly cut, the band range for the antenna can be made as broad as possible. Furthermore, by resonating the antenna element 10 at the length $\lambda/2$ and using it at a high level impedance, the antenna can be used as almost a perfect non-grounded type antenna.

FIG. 5 shows a second embodiment of the present invention, and FIG. 6 is an equivalent circuit of this second embodiment.

The second embodiment differs from the first embodiment in two aspects. First, in the second embodiment, the antenna element **10*a* is not connected to the other end 42 of the first metal plate 40. Instead, a second metal plate 40*a* is provided in the casing 20*a* in addition to and above the first metal plate 40, and the antenna element 10*a* is connected to this second metal plate 40*a*. Second, an electrostatic capacitance Ca is created between the first metal plate 40 and the second metal plate 40*a*, and a constant K-filter is formed by the residual inductance of the antenna element 10*a*** and the electrostatic capacitance Ca.

The lower half of the antenna element **10*a* is slightly shorter than the length $\lambda/2$ at the working frequency. Thus, in FIG. 5, the length of lower half of the antenna element 10*a*** is represented as $\lambda/2-\alpha$. Other elements of the second embodiment are the same as the first embodiment.

In the second embodiment, the antenna element is designed slightly shorter than the parallel resonance point so that it functions effectively for broad band and high fidelity reception.

FIG. 7 shows characteristic curve of the antenna **10*a* of the second embodiment, and FIG. 8 is an equivalent circuit therefor. FIG. 9(1) shows a constant K-filter, and FIG. 9(2)** shows the characteristics thereof.

Instead of the antenna elements 10 and **10*a*** of the above described embodiments, an antenna element having a length $\lambda/2$ at the working frequency or antenna elements having lengths which are multiply of $\lambda/2$ at the working frequency may be used to obtain the same effect as those in the above embodiments. Also, the antenna according to the present invention can be used for other than automobile antennas.

Furthermore, with a double-sided adhesive tape 60 attached to the bottom of the casing 20, the antenna can be mounted on a vehicle body very easily.

As described above, a large space is not required for the antenna base and the antenna can provide a light weight appearance without losing its high performance characteristics.

I claim:

1. A non-grounded type ultrahigh frequency antenna characterized in that said antenna comprises:

an antenna element having a length substantially equal to $\lambda/2$ at a working frequency;

a casing provided at the base of said antenna element;

a metal section which is a part of said casing, said metal section having a length of approximately $\lambda/4$ at said working frequency;

a first metal plate provided in said casing, one end of said metal plate being grounded and another end being coupled to said antenna element, said first metal plate further being provided above said metal section and parallel thereto; and a second metal plate provided between said antenna element and said first metal plate, said second metal plate being provided above said first metal plate and parallel thereto;

wherein a constant K-filter is formed by an electrostatic capacitance between said first and second metal plates and a residual inductance of said antenna element, and said antenna is made parallel-resonant within said working frequency by said electrostatic capacitance created between said first metal and said second metal plate and an inductance of said first metal plate.

2. An antenna according to claim 1, wherein said first metal plate is rectangular shape.

3. An antenna according to claim 1, wherein said casing is provided with a double-sided adhesive tape at its bottom.

4. A non-grounded type ultra high frequency antenna characterized in that said antenna comprises:

an antenna element having a length substantially equal to an intermultiple of $\lambda/2$ at a working frequency;

a casing provided at the base of said antenna element;

a metal section which is a part of said casing, said metal section having a length of approximately $\lambda/4$ at said working frequency;

a first metal plate provided in said casing, one end of said metal plate being grounded and another end being coupled to said antenna element;

a second metal plate provided between said antenna element and said first metal plate; and a double-sided adhesive tape at a bottom of said casing;

wherein a constant K-filter is formed by an electrostatic capacitance between said first and second metal plates and a residual inductance of said antenna element and said antenna is made parallel-resonant within said working frequency by said electrostatic capacitance created between said first metal plate and said second metal plate and an inductance of said first metal plate.

* * * * *